US005501467A

United States Patent [19]

Kandel

[11] Patent Number: 5,501,467

[45] Date of Patent: Mar. 26, 1996

[54] HIGHLY VISIBLE, POINT OF IMPACT, FIREARM TARGET-SHATTERABLE FACE SHEET EMBODIMENT

[76] Inventor: Walter Kandel, 4159 N. Overlook Ter., Portland, Oreg. 97217

[21] Appl. No.: 349,007

[22] Filed: Dec. 2, 1994

Related U.S. Application Data

[63] Continuation of Ser. No. 171,336, Dec. 14, 1993, abandoned, which is a continuation-in-part of Ser. No. 55,555, May 3, 1993, abandoned.

[51] Int. Cl.[6] ..... F41J 5/18

[52] U.S. Cl. ..... 273/378; 273/403; 273/408; 273/409

[58] Field of Search ..... 273/376, 378, 273/181 R, 403, 409, 408, 380; 40/157, 159.2, 158.1; 359/885, 892; 283/64

[56] References Cited

U.S. PATENT DOCUMENTS

| | | | |
|---|---|---|---|
| 2,871,601 | 2/1959 | Warnow | 40/159.2 |
| 3,264,767 | 8/1966 | Coffman | 40/159.2 |
| 3,512,778 | 5/1970 | Allen | 273/403 |
| 3,899,175 | 8/1975 | Loe | 273/378 |
| 3,986,283 | 10/1976 | Pelaez | 40/158.1 |
| 4,341,053 | 7/1983 | Anthony | 40/157 |
| 4,462,598 | 7/1984 | Chalh et al. | 273/408 |
| 5,160,133 | 11/1992 | Bloom | 273/408 |
| 5,188,371 | 2/1993 | Edwards | 273/378 |
| 5,275,890 | 1/1994 | Wolf et al. | 273/181 R |

*Primary Examiner*—Mark S. Graham
*Attorney, Agent, or Firm*—Eugene D. Farley

[57] ABSTRACT

A firearm target providing self-enlarging, highly visible, bullet puncture openings. The target comprises a backing sheet and a target-marked face sheet comprising an impact shatterable material which shatters on impact by a bullet, enlarging the opening and exposing an enlarged area of the backing sheet. The face surfaces of the face sheet and backing sheet are of contrasting colors, thereby increasing substantially the visibility of the bullet impact area.

Adhesive, stitching or other holding means holds the face sheet across the backing sheet.

19 Claims, 3 Drawing Sheets

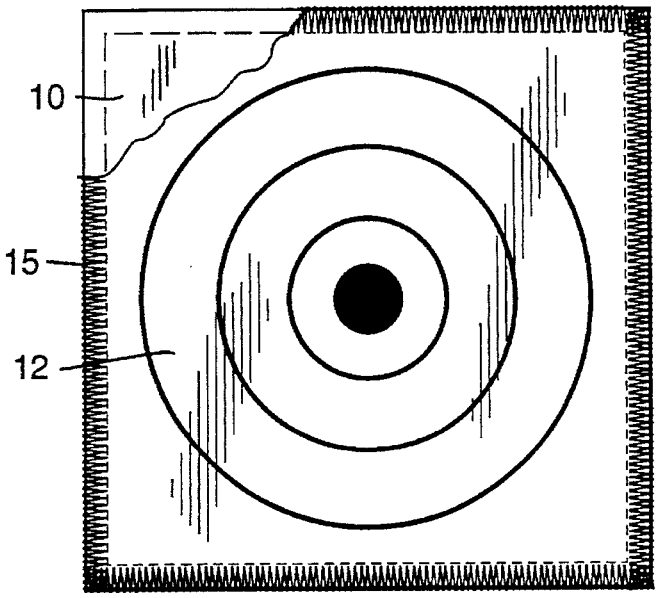
FIG. 4
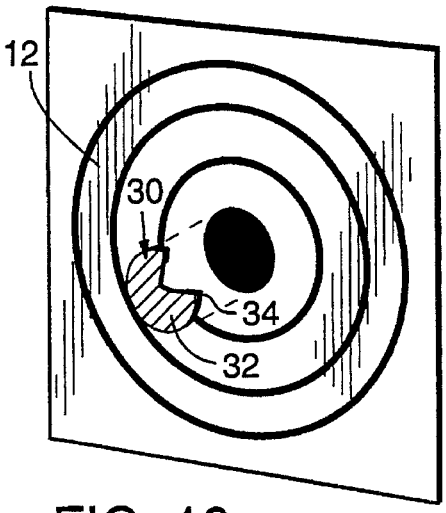
FIG. 10
FIG. 11
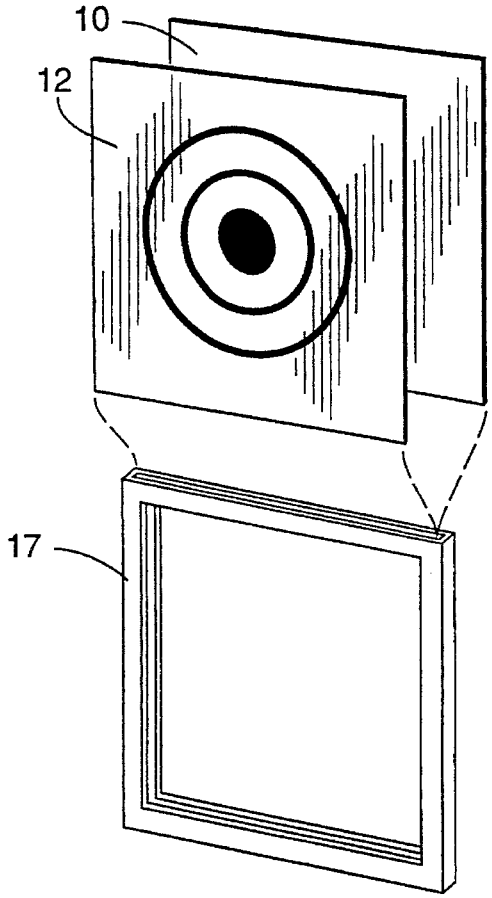

FIG. 5
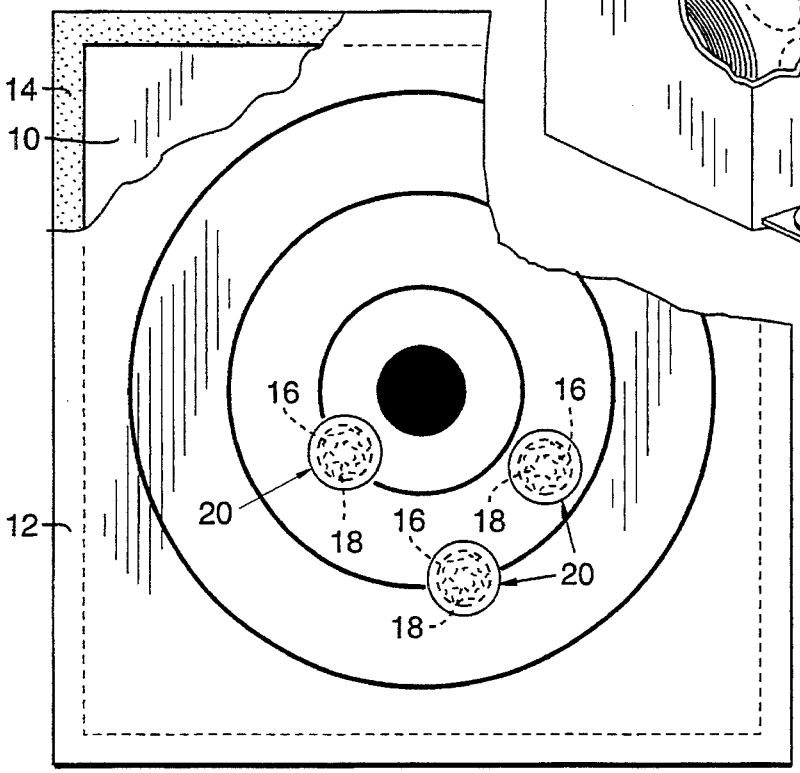
FIG. 9
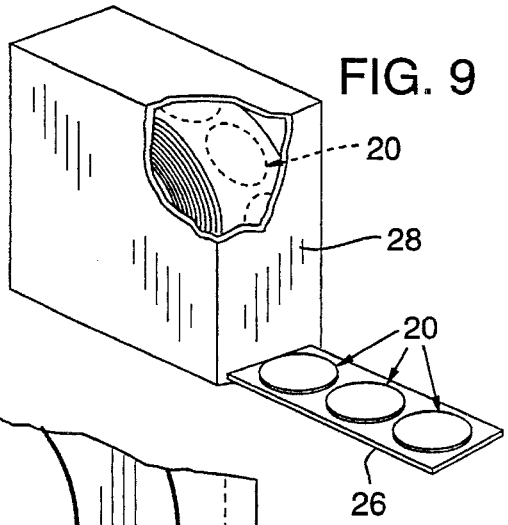
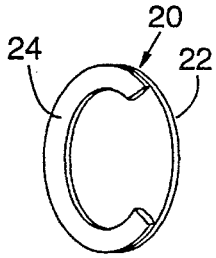
FIG. 8
FIG. 6
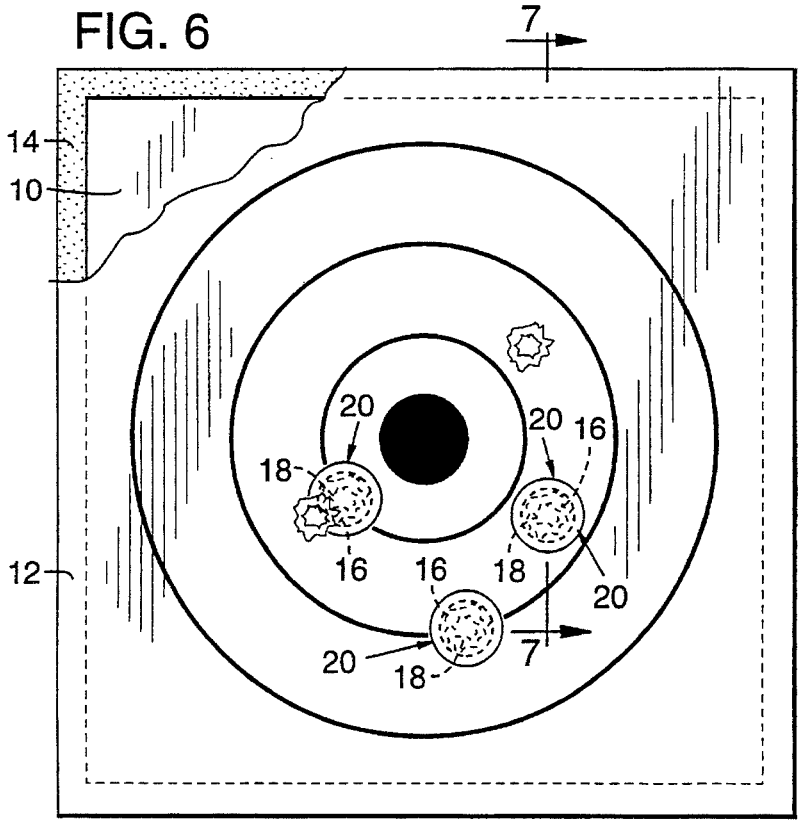
FIG. 7
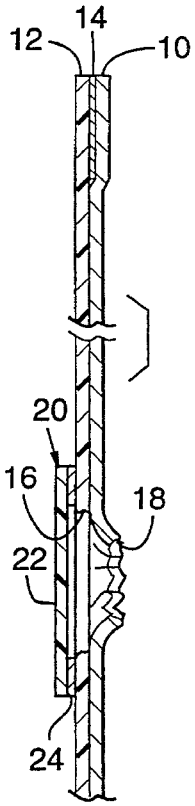

HIGHLY VISIBLE, POINT OF IMPACT, FIREARM TARGET-SHATTERABLE FACE SHEET EMBODIMENT

This application is a continuation of application Ser. No. 08/171,336, filed Dec. 14, 1993, now abandoned which is a continuation-in-part of application Ser. No. 08/055,555, filed May 3, 1993, abandoned.

BACKGROUND OF THE INVENTION

1. Field of the Invention

This invention relates to a highly visible, point of impact, firearm target. It pertains particularly to firearm targets suitable for use at long range wherein the bullet puncture area enlarges and becomes readily visible from a distance.

2. Description of the Prior Art

A commonplace problem presented when target shooting with conventional targets, particularly during long range target shooting, is the fact that the bullet holes through the target are almost invisible to the marksman. This problem is particularly acute when the rounds are of small caliber. Hence, when it is desired to determine the shooting score after firing a number of rounds, it often is necessary to travel to the target in order to inspect it at close range. After each inspection, the marksman must return to the shooting station before resuming practice. This obviously is a time-consuming routine which is irritating and interrupts the marksman's attentive effort.

It heretofore has been proposed (Loe U.S. Pat. No. 3,895,803) to provide a laminar indicating target wherein the face surfaces of the laminae are of contrasting colors. Upon bullet impact, the outer layer is caused to separate from the underlying layer in the vicinity of the bullet hole, thereby rendering the location of the impact more readily visible because of the exposure of an increased area of the underlying lamina of a contrasting color.

In practice, this desired result is difficult to achieve for two fundamental reasons:

First, it is difficult to provide an outer lamina which will not soak into, or be transferred to, the underlying lamina, thereby destroying the color contrast between the two laminae and thwarting the purposes of the invention.

Second, it is difficult to provide a surface lamina which, upon bullet impact, is removed selectively to the desired degree in the immediate area of the bullet hole only. It will be apparent that if a sufficient amount of the surface lamina is not removed, the purpose of the target is thwarted. On the other hand, if too much of the surface lamina is removed, the bullet holes will not be marked separately from each other but will fuse one into the other. This also defeats the purposes of the target.

PRESENT INVENTION

The present invention has for its object the provision of a highly visible, point of impact firearm target which overcomes the problems of the laminar target described above and is characterized by the presence of enlarged, highly visible and readable bullet punctures after each use.

It is a further object of the present invention to provide a self-marking target which may be manufactured easily and inexpensively, and which is usable in accordance with conventional target shooting practices, but with the expenditure of much less effort.

Still another object of the present invention is the provision of a self-marking target which is amenble to patching, both to adapt it for a special purpose and/or to prepare it for re-use after it has been punctured during a preceding use.

The foregoing and other objects of my invention are achieved by the provision of a firearm target comprising a backing sheet of target grade paper or other suitable target material and, superimposed thereon, a discrete face sheet comprising an impact-shatterable material which shatters selectively in the immediate area of bullet impact upon impact by a bullet.

The outer face of the face sheet is imprinted or marked with a target of suitable character. The outer faces of the face sheet and backing sheet are of sharply contrasting colors, for example white and fluorescent red, or black.

Holding means such as adhesive means holds the face sheet to the backing sheet, principally in the superimposed marginal areas.

In use, the frangible face sheet shatters around the margins of the bullet hole upon impact by a bullet. This reveals an enlarged area of the underlying backing sheet of a contrasting color, thereby making the bullet hole more readily visible from a distance.

THE DRAWINGS

In the drawings:

FIG. 4 is a fragmentary plan view illustrating an alternate means for attaching the target face sheet to its underlying backing sheet.

FIG. 5 is a fragmentary plan view, similar to FIG. 2, illustrating a used target patched for reuse.

FIG. 6 is a plan view illustrating the patched target of FIG. 5 after a second use.

FIG. 7 is a sectional view taken along line 7—7 of FIG. 6.

FIG. 8 is an underside perspective view of the patch employed in the targets of FIGS. 5 and 6.

FIG. 9 is a perspective view, broken away to show interior construction, of a dispensing assembly which may be employed for the storage and dispensing of the patches of FIG. 8.

FIG. 10 is a fragmentary, exploded, perspective view illustrating the target of the invention in association with a bulls-eye patch which adapts the target for a special purpose.

FIG. 11 is an exploded perspective view illustrating still another method of assembling the target.

DESCRIPTION OF SPECIFIC EMBODIMENTS OF THE INVENTION

Figure 1:
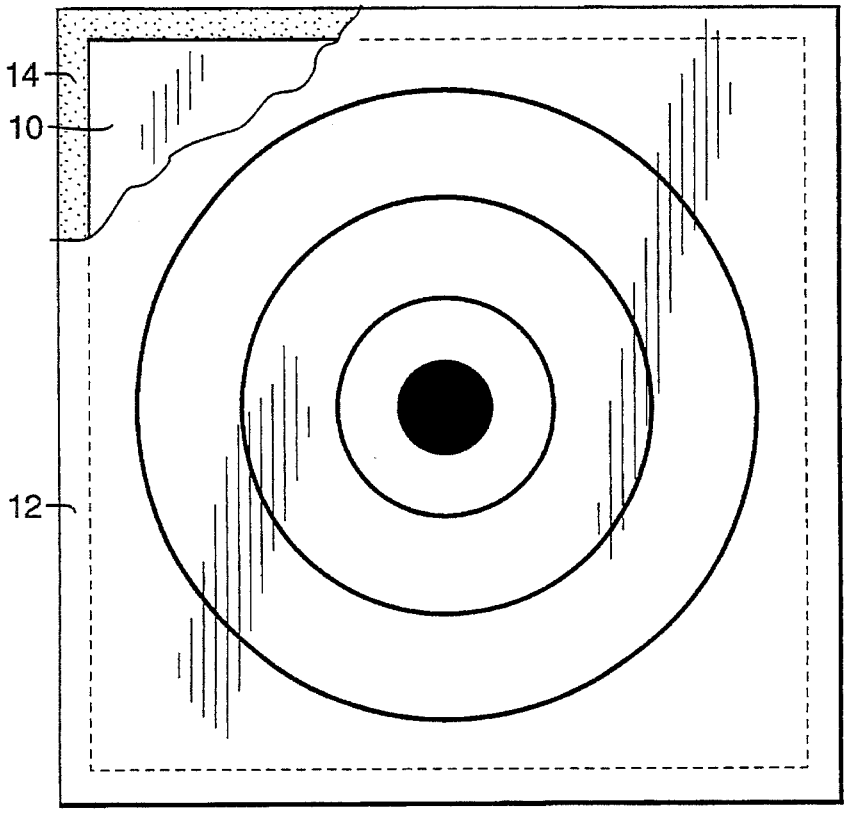
FIG. 1 is a plan view of the highly visible firearm target of my invention, with the face sheet thereof partly removed, the target being in pristine, unused condition.

As shown in the drawings, the target comprises a backing sheet 10 over which is superimposed a discrete face sheet 12. The two sheets are held together in the marginal area by suitable means, such as by means of an adhesive 14, FIG. 1, applied principally in the superimposed marginal areas of the sheets, or by means of marginal stitching 15, FIG. 4. A spot application of adhesive may be desirable or necessary in other selected areas of the target. However, to achieve the purpose of the invention it is necessary to maintain the laminae substantially completely separate and discrete from each other in the target area.

This objective also may be achieved by the expedient illustrated in FIG. 11. A slotted, internally grooved or slotted frame 17, open on one side, is used to hold face sheet 12 and backing sheet 10 in close juxtaposition. In this mode of practicing the invention, the marksman may be supplied with a single frame and a packet of face and backing sheets, pairs of which may be inserted in the frame on the shooting range, as the preceding pairs are consumed by rifle fire.

Backing sheet 10 preferably comprises a sheet of heavy, target-grade paper, cardboard, or plastic of suitable thickness, for example a thickness of from 0.03 to 0.125 inch. It preferably is of relatively low impact strength: that is, it has but a slight resistance to the passage of a bullet. As a result, the bullet hole created by the passage of the bullet will have a diameter not much greater, or no greater, than the diameter of the bullet itself. This increases the area of exposure of the backing sheet and correspondingly increases the visibility of the point of bullet impact.

Face sheet 12 comprises an impact-shatterable (frangible) material which shatters selectively in the immediate area of bullet impact upon impact by a bullet. It is a discrete component and has a thickness of from 0.001 to 0.250 in., preferably 0.003–0.175 in. It is marked on its outer face with a suitable target pattern. The color of its face surface should contrast sharply with the color of the face surface of backing sheet 10.

Although various colors may be employed, it is preferred to use sharply contrasting colors, for example fluorescent red and white, blue and white, green and white or conventional black and white. The color may characterize the face surfaces only of the two sheets, or it may be solid throughout the body of the sheets.

Furthermore, the face sheet should be characterized by shattering selectively in the immediate vicinity of bullet impact only. This avoids overlap of the impact areas, making the target difficult or impossible to read accurately.

Suitable impact-shatterable material for use in sheet form as target face sheets 12 are the impact-shatterable plastic sheet materials, in particular impact-shatterable polyvinyl chloride resin acrylic resin polyamide resin polystyrene resin polyethylene terephalate Illustrative of suitable acrylic resins are polymethyl methacrylate polyethyl methacrylate polybutyl methacrylate To obtain the desired properties of rigidity, frangibility and stability these resins may be blended with minor proportions of various conventional resin modifying agents.

Figure 2:
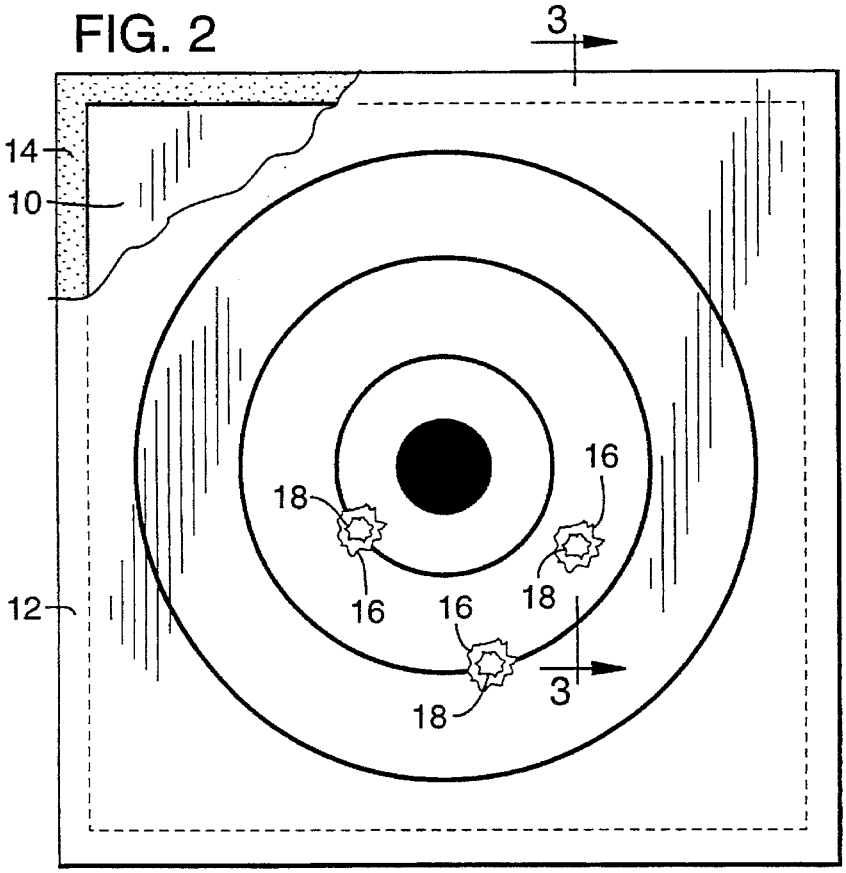
FIG. 2 is a plan view similar to FIG. 1 illustrating the appearance of the target after use.
Figure 3:
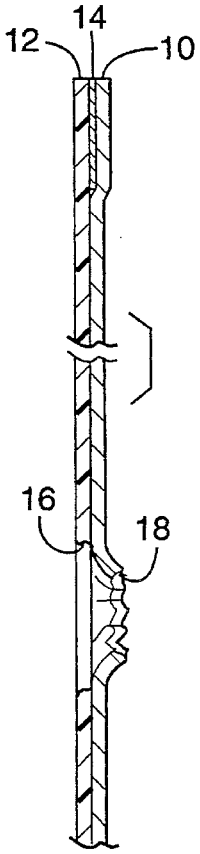
FIG. 3 is a fragmentary sectional view taken along line 3—3 of FIG. 2.

After use, the target has the appearance shown in FIGS. 2 and 3. Upon striking face sheet 12 the bullet shatters the same in the area of the bullet hole to form an enlarged bullet hole 16.

Backing sheet 10 does not shatter. Bullet hole 18 through backing sheet 10 accordingly is considerably smaller than bullet hole 16. There thus is presented to view the surrounding area of the backing sheet, which is visible from a great distance.

As indicated above, it is a particular feature of the present invention that the self-marking target which is its subject matter is amenble to patching, both to adapt it for a special purpose as well as to prepare it for re-use after it has been punctured during a preceding use.

In both embodiments the patch is contoured and dimensioned for application to a selected area of the target face sheet. It comprises a piece of impact-shatterable material having a marginal application of adhesive for affixation of the patch to the said face sheet area. It thus covers over the area and renews the target surface with frangible material so that the target may be reused, or used for a different purpose.

The manner in which this expedient adapts the target for reuse is illustrated in FIGS. 6–8 inclusive.

As illustrated in FIG. 8, the patch indicated generally at 20, simply comprises a face sheet 22 of frangible material having on its inner or reverse side a peripheral application 24 of adhesive. Face sheet 22 is dimensioned and contoured to overlie and conceal bullet hole 16 in the manner shown in FIG. 7. All such bullet holes may be patched as illustrated in FIG. 5., thereby renewing the target for reuse.

After such reuse, the target has the appearance illustrated in FIG. 6. Upon bullet impact, the frangible face sheet 22 of each patch 20 shatters in the same manner as does frangible face sheet 12 which overlies the entire target. As a result, the bullet hole area is enlarged in the patched target area to create a highly visible puncture.

The identity and nature of patch face sheet 22 and of adhesive application 24 are of the same character as is described above in connection with face sheet 12 and adhesive application 14 which characterize the principal target.

Target patches 20 may be conveniently stored and dispensed by securing them with a releasable adhesive to a tape 26 rolled up and stored in, and dispensed from, a container 28 in the manner illustrated in FIG. 9.

The manner in which the patch concept may be applied to adapting the targets of the invention to a special purpose is illustrated in FIG. 10.

Particularly when using rifles equipped with telescopic sights, it is common practice to target shoot at great distances, for example distances of as much as from 100 to 200 yards. At such distances, the hunter is fortunate to be able to see the target, let alone the target bulls-eye.

For use in such a situation there may be employed special bulls-eye patches 30 such as are illustrated in FIG. 10. These patches comprise a frangible face sheet 32 having on their reverse or inner surfaces peripheral applications of an adhesive 34, as above described.

Face sheet 32 of bulls-eye patch 30 has an appearance which contrasts sharply with the appearance of face sheet 12 of the target which it overlies.

Thus, if face sheet 12 is of a dark color, such as black or dark blue, face sheet 32 of the bulls-eye patch may be light green in color.

Preferably, face sheet 32 of the bulls-eye patch is of a material which is highly light reflective. Thus it may have a scintillating or mirror surface. Then when the target is placed in the sun, the resulting light reflection from the bulls-eye patch will render the target visible at very great distances.

Having thus described in detail preferred embodiments of the present invention, it will be apparent to those skilled in the art that many physical changes may be made without altering the inventive concepts and principles. The present embodiments are therefore to be considered in all respects as illustrative and not restrictive, the scope of the invention being indicated by the appended claims.

I claim:

1. A firearm target having a target area and comprising:

a) a backing sheet of target material, b) a superimposed, target-marked discrete face sheet comprising an impact-shatterable material which in the immediate area of bullet impact shatters selectively to form a bullet hole which is substantially larger than the bullet hole through the backing sheet, thereby exposing a substantial area of the face surface of the backing sheet, c) the backing sheet and face sheet having face surfaces of contrasting colors, and d) marginal holding means holding the face sheet to the backing sheet, selectively in the superimposed marginal areas thereof and arranged for maintaining the sheets substantially completely separate and discrete from each other in the target area.

2. The firearm target of claim 1 wherein the holding means comprises frame means.

3. The firearm target of claim 1 wherein the holding means comprises internally grooved frame means open on one side.

4. The firearm target of claim 1 wherein the backing sheet comprises a paper backing sheet.

5. The firearm target of claim 1 wherein the face sheet comprises an impact-shatterable plastic face sheet.

6. The firearm target of claim 5 wherein the plastic face sheet comprises a sheet of at least one member of the group consisting of polyvinyl chloride resin, acrylic resin, polyamide resin, polystyrene resin, and polyethylene terephthalate resin.

7. The firearm target of claim 6 wherein the face sheet comprises a sheet of polyvinyl chloride resin.

8. The firearm target of claim 6 wherein the face sheet comprises a sheet of acrylic resin.

9. The firearm target of claim 6 wherein the face sheet comprises a sheet of polyethylene terephthalate resin.

10. The firearm target of claim 1 wherein the holding means comprises securing means securing the face sheet to the backing sheet, principally in the superimposed marginal areas thereof.

11. The firearm target of claim 10 wherein the securing means comprises adhesive means.

12. The firearm target of claim 10 wherein the securing means comprises marginal stitching.

13. The target of claim 1 in combination with a patch contoured and dimensioned for application to a selected area of the target face sheet, the patch comprising a piece of impact-shatterable material having a marginal application of adhesive for affixation of the patch to said target face sheet area.

14. The target of claim 13 wherein said selected area is an area containing a bullet hole.

15. The target of claim 13 wherein a said selected area is a bulls-eye and another patch includes a face surface of highly visible character.

16. The target of claim 15 wherein the patch has a light-reflective face surface.

17. The target of claim 15 wherein the patch has a scintillating face surface.

18. The target of claim 15 wherein the patch has a mirrored face surface.

19. A firearm target comprising:

a) a backing sheet of target-grade paper, b) a superimposed, target-marked, discrete face sheet comprising an impact-shatterable polyethylene terephthalate resin sheet which shatters selectively in the immediate area of bullet impact upon impact by a bullet, the backing sheet and face sheet having face surfaces of a contrasting color, and c) marginal stitching means securing the face sheet to the backing sheet.

* * * * *